United States Patent [19]

Suzuki et al.

[11] Patent Number: 4,693,637

[45] Date of Patent: Sep. 15, 1987

[54] GRAVITY TYPE OCEANIC STRUCTURE AND ITS STABLE INSTALLATION

[75] Inventors: Yoshio Suzuki; Yoshio Suzuki; Satoshi Saitoh; Mituoki Yamamoto, all of Tokyo; Hisashi Hosomi, Saitama, all of Japan

[73] Assignee: Takenaka Komuten Co., Ltd., Osaka, Japan

[21] Appl. No.: 801,847

[22] Filed: Nov. 26, 1985

[30] Foreign Application Priority Data

Dec. 20, 1984 [JP] Japan ..... 59-270240

[51] Int. Cl.[4] ..... E02B 17/00

[52] U.S. Cl. ..... 405/224; 114/296; 405/195; 405/203; 405/205

[58] Field of Search ..... 405/224, 208, 207, 203, 405/224, 195, 205; 114/296, 293, 294

[56] References Cited

U.S. PATENT DOCUMENTS

| | | | |
|---|---|---|---|
| 2,652,693 | 9/1953 | Goldman et al. | 405/208 |
| 2,938,353 | 5/1960 | Vorenkamp | 405/207 |
| 3,021,680 | 2/1962 | Hayward | 405/207 |
| 3,529,919 | 9/1970 | Tiraspolsky et al. | 114/296 |
| 3,896,628 | 7/1975 | Hansen | 405/207 |
| 3,906,734 | 9/1975 | Pogonowski et al. | 405/225 |
| 3,911,687 | 10/1975 | Mo | 405/225 |
| 4,036,161 | 7/1977 | Nixon | 114/296 |
| 4,040,263 | 8/1977 | Eide et al. | 405/195 |
| 4,043,424 | 12/1977 | Takagi et al. | 405/222 X |
| 4,397,586 | 8/1983 | Weiss | 405/217 |
| 4,420,275 | 12/1983 | Ruser | 405/217 |
| 4,425,055 | 1/1984 | Tiedemann | 405/207 X |
| 4,470,725 | 9/1984 | Kure et al. | 405/217 X |

FOREIGN PATENT DOCUMENTS

| | | |
|---|---|---|
| 50-1303 | 1/1975 | Japan . |
| 51-43811 | 4/1976 | Japan . |
| 56-28921 | 3/1981 | Japan . |
| 56-26725 | 6/1981 | Japan . |
| 56-150222 | 11/1981 | Japan . |
| 57-66216 | 4/1982 | Japan . |
| 2058181 | 4/1981 | United Kingdom . |

*Primary Examiner*—Dennis L. Taylor
*Attorney, Agent, or Firm*—Parkhurst & Oliff

[57] ABSTRACT

The present invention relates to a gravity type oceanic structure and its stable installation wherein a skirt is provided downward on the outside periphery of the lower end of the part to be settled and fixed on the sea bed. When the structure is settled on the sea bed, the skirt is pushed into the sea bed foundation to intercept penetration of sea water from the circumference into the structure, and sea water in the skirt is adequately discharged by draining means to make the internal pressure equal to the atmospheric pressure. Buoyancy is thereby eliminated so that the bottom surface of the structure is fixed firmly to the sea bed.

10 Claims, 7 Drawing Figures

GRAVITY TYPE OCEANIC STRUCTURE AND ITS STABLE INSTALLATION

BACKGROUND OF THE INVENTION

1. Field of the Invention

The present invention relates to an oceanic structure for ocean development such as a platform for sea bed oil excavation, a one-point mooring buoy type mooring facility for transfer of crude oil to and from large tankers, a deep sea anchor and a measurement table and more particularly a gravity type oceanic structure and its stable installation.

2. Description of the Related Art

As a fixing technology of a bottom settling type oceanic structure, two methods are known. One is a gravity type fixing with which the structure is fixed by its own weight in water and the other is a piling type fixing with which piles are driven into the foundation and the structure is fixed to these piles.

However, in gravity fixing, since the structure's buoyancy is proportional to its volume in water, the weight of the structure itself must be great in order to settle itself on the sea bed and fix itself. Especially, in order to fix the structure against horizontal forces such as earthquake force and ice pressure, the bottom surface of the structure must adhere to the sea bed surface tightly to increase the pressure (effective contact pressure) which is transmitted from the bottom surface of the structure to the sea bed foundation surface, and the strength of the sea bed foundation must be fully utilized. Therefore, the weight of the structure itself must be even larger and high cost is unavoidable.

In the pile structure, the water depth in which this structure can be applied is limited, and when the structure is removed, the piles must be removed too as they are regarded as parts of the structure; and hence high cost is again unavoidable.

SUMMARY OF THE INVENTION

It is an object of the present invention to provide a stable installation of a gravity type oceanic structure which weighs as little as possible, which produces effective contact pressure large enough to settle and fix itself on the sea bed, and which can withstand large horizontal force.

It is also an object of the present invention to provide a stable installation of a gravity type oceanic structure which facilitates operations such as floating, transferring of the structure, and settling and fixing of the structure on the sea bed, and which makes construction favorable.

It is also an object of the present invention to provide a gravity type oceanic structure which can be applied to all kinds of oceanic structures to be settled and fixed on the sea bed and which can facilitate significant cost reduction.

DETAILED DESCRIPTION OF THE INVENTION

One embodiment of the present invention will be described hereinunder with reference to the accompanying drawings.

Figure 1:
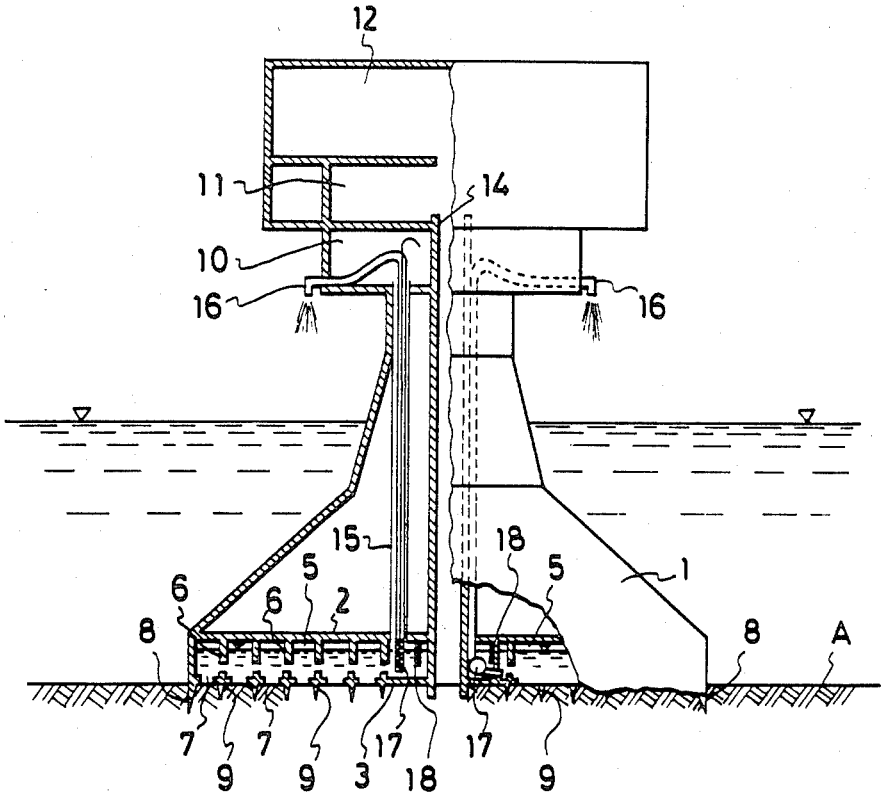
FIG. 1 is a front view of a gravity type oceanic structure of the present invention partly in cross-section.
Figure 2:
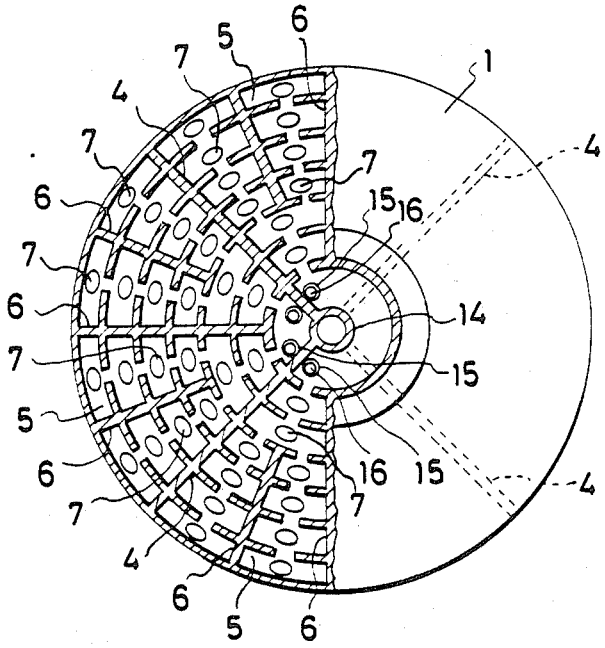
FIG. 2 is a transverse partial cross-sectional view of a lower part of the gravity type oceanic structure shown in FIG. 1.

FIG. 1 and FIG. 2 show a platform for sea bed oil excavation as one embodiment of a gravity type oceanic structure of the present invention and also show the case when the sea bed is composed of cohesive soil which is firm and relatively impermeable.

As shown in FIG. 1 and FIG. 2, a lower part of the structure 1 is expanded and a bottom plane has a round shape. Layers of upper level and lower level slabs 2 and 3 are provided on the bottom of the structure 1 which is settled on the sea bed, wherein the upper level slab 2 is so constructed as to have strength high enough to withstand water pressure proportional to water depth and to maintain watertight integrity. Four vacant watertight chambers 5 are formed in a space between the two slabs 2, 3 by radial partitions 4 and each vacant chamber 5 is again divided by a reinforcing wall 6 of an optional form which is provided continuously between the two slabs.

It is preferable that the reinforcing wall 6 be shaped such that it divides each vacant chamber 5 radially and annularly into a plurality of small chambers and links the small chambers in the same vacant chamber with each other.

A number of penetration holes 7 are drilled in the lower level slab 3 to facilitate the flow of sea water into each vacant chamber 5.

It is preferable that one penetration hole 7 be provided in every small chamber mentioned above so that water pressure will be applied uniformly to the bottom of the structure.

Moreover, a skirt 8 of a suitable length with a sharp edge is vertically provided downward solidly on an outside periphery of the lower level slab 3 and a plurality of protrusions 9 of suitable lengths with sharp edges are provided on the bottom surface of the lower level slab 3 at suitable intervals.

It is preferable from the viewpoint of strength that a plurality of the protrusions 9 are provided downward solidly on the bottom surface of the lower level slab 3.

On top of the structure 1 a machine room 10 is installed, and above the machine room 10 two-storied operation rooms 11 and 12 are installed. At the center of the structure 1, a center pipe 14 is provided through which an oil drilling apparatus (not shown) is inserted. The center pipe 14 penetrates upper level and lower level slabs 2 and 3 and machine room 10.

A plurality of hollow rising shafts 15 link the respective vacant chambers 5 with the machine room 10, and draining pipes 16 connect the respective vacant chambers 5 to the outside of the structure through the machine room 10. Draining pumps 17 are provided in the respective vacant chambers 5 at the bottom of the drain pipes 16 and facilitate discharging sea water which flows into the vacant chambers out of the structure.

Submersible pumps, force pumps and other suitable pumps can be used as the draining pumps 17. A water level detector 18 is provided near the draining pump 17 in each vacant chamber 5.

A gravity type oceanic structure of the present invention is constituted as mentioned above. The structure is floated by utilizing the air in the structure itself, and is towed to the installation site. After arrival at the installation site, the structure is sunk and settled on the sea bed surface of the foundation A (of cohesive soil with high stength and low permeability).

Then the skirt 8 and the protrusions 9 are pushed into the sea bed to make the structure withstand horizontal force; at the same time, the skirt 8 intercepts sea water flowing into the skirt from the circumference. By operating each draining pump 17, sea water flowing into each vacant chamber 5 is adequately drained out through the draining pipe 16 to make pressure in each chamber 5 equal to the atmospheric pressure, thereby causing the settled part to physically adhere tightly to the sea bed.

After that, water level in each vacant chamber 5 is observed by a water level detector 18 and if the water level exceeds the predetermined value, the draining pump 17 is operated automatically or manually to keep the water level approximately constant and maintain a stable fixed condition.

Figure 3:
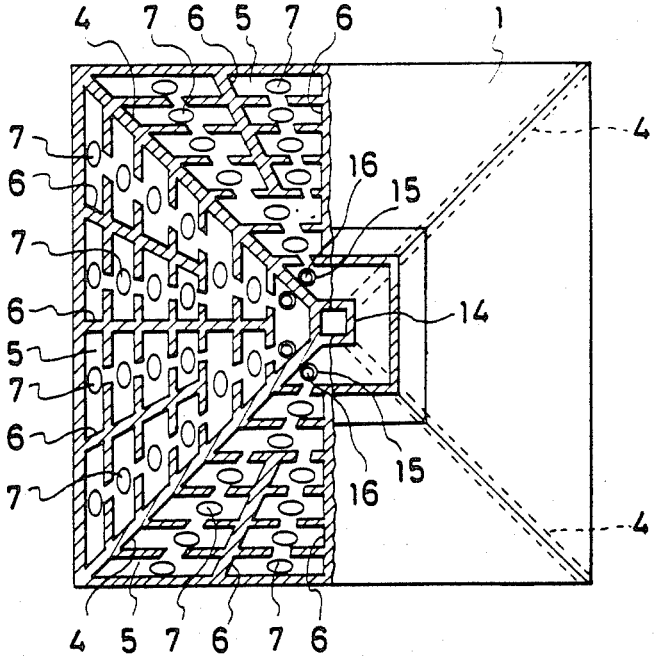
FIG. 3 is a transverse partial cross-sectional view of a modified embodiment of the embodiment shown in FIG. 2.

The lower part of the structure mentioned above is formed into a circular plane, but it may be formed into a square plane as shown in FIG. 3 or into other shapes.

Figure 4:
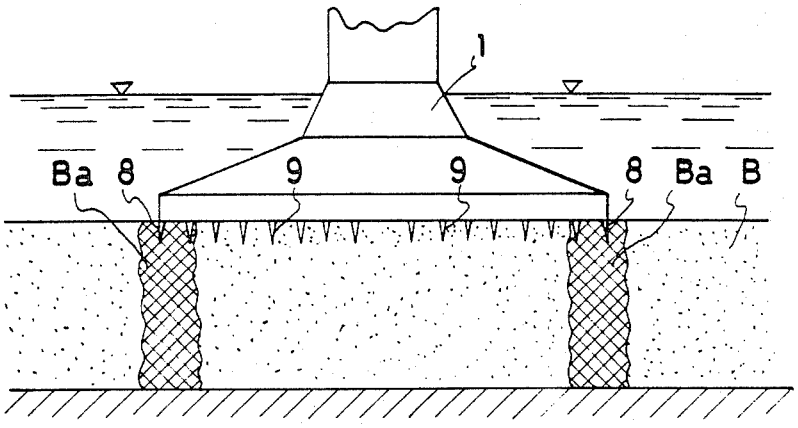
FIG. 4 is a side view partly in cross-section showing an installation means on a water permeable sandy foundation.
Figure 5:
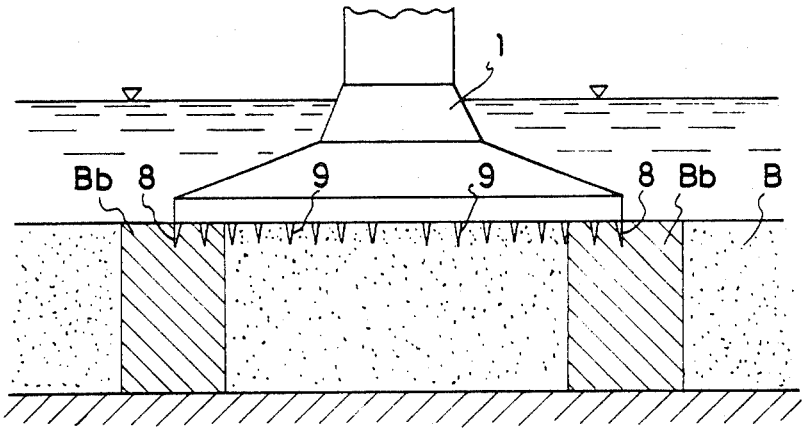
FIG. 5 is a side view partly in cross-section showing a modified embodiment of the embodiment shown in FIG. 4.

FIG. 4 and FIG. 5 show an installation means of a gravity type oceanic structure of the present invention when the structure is installed on a tight sandy foundation B with high water permeability and sufficient bearing capacity.

As depicted in FIG. 4, a suitable liquid chemical is injected into the sandy foundation B corresponding to the skirt 8 to form an improved domain Ba of an underground wall shape with little water permeability, and then the skirt 8 and the protrusions 9 are pushed into the improved domain Ba. As depicted in FIG. 5, a part of the sandy ground B corresponding to the skirt 8 is improved by a deep layer mixing treatment method to form an improved domain Bb of an underground wall shape and then the skirt 8 and protrusions 9 are pushed into the improved domain Bb.

Depth, width and shape of the improved domains Ba and Bb may be suitably predetermined in accordance with the situation of the site.

Figure 6:
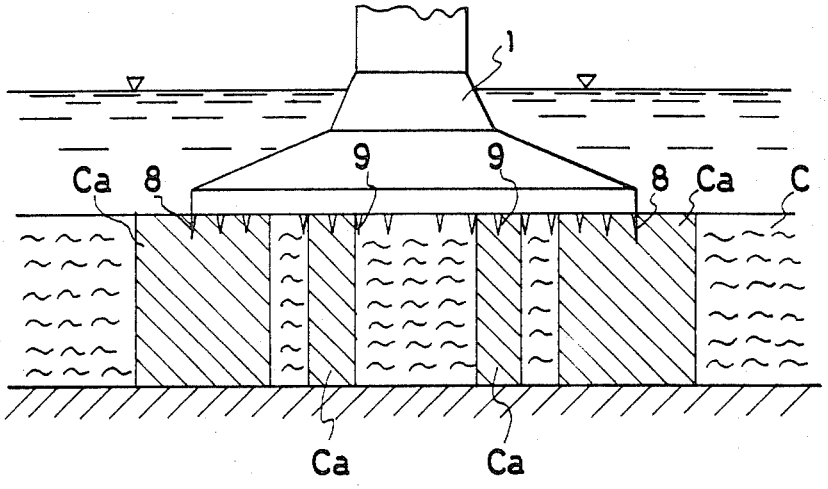
FIG. 6 is a side view partly in cross-section showing an installation means on a poor ground which does not have sufficient strength.

FIG. 6 shows an installation means of a gravity type oceanic structure of the present invention when the sea bed soil C is poor and has insufficient bearing capacity.

In this case, suitable parts of the poor soil C corresponding to the skirt 8 and the protrusions 9 are improved into firm foundations Ca of suitable shapes which are almost impermeable to water by the deep layer mixing treatment method.

Figure 7:
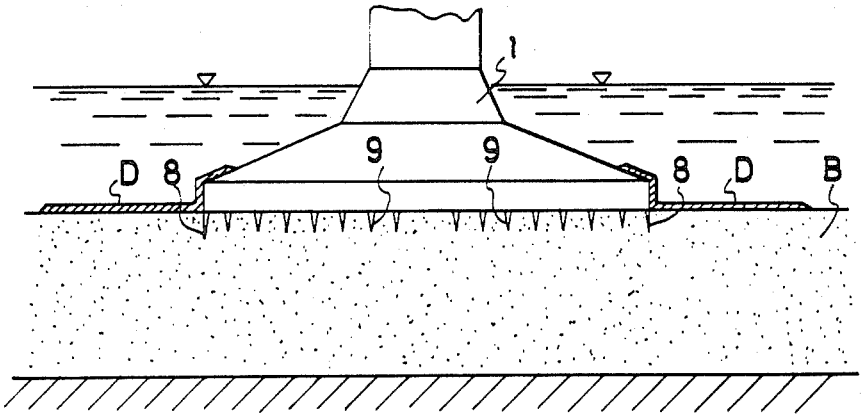
FIG. 7 is a side view partly in cross-section showing another installation means on a sandy foundation.

FIG. 7 shows other installation means of a gravity type oceanic structure of the present invention when the structure is installed on a stiff sandy ground with good permeability and sufficient bearing capacity.

In this case, the sandy ground B is not improved and a periphery of the structure and the sea bed around the structure are covered with an impervious rubber sheet D to prevent sea water penetration from the circumference.

Although a platform for sea bed oil excavation is described in above embodiment, it is for description only and is not intended as a definition of the limits of the invention. As a matter of fact, the present invention can be applied to a one-point mooring buoy type mooring facility for receipt and payment of crude oil from a large tanker, a deep sea anchor, a measurement table and other various types of oceanic structures.

With the present invention, a gravity type oceanic structure can be settled and fixed on the sea bed physically and tightly with adequate bottom area and held steadily against large horizontal force. The installation operation is very easy with very simple constitution so that the present invention facilitates significant cost reduction.

The deeper the water, the more effective the present invention. The present invention can be applied satisfactorily to all oceanic structures which are settled and fixed on the sea bed and, in the case of a transferable structure, floating, transfer and settling and fixing are easy, and significant effectiveness can be obtained.

What we claim is:

1. A method of utilizing a gravity-type transferable oceanic structure of the type including a body; ballasting means within at least a portion of said body; a hollow bottom, extending from a lower end of said body, which is of larger dimension in horizontal cross-section than an upper portion of said body, said hollow bottom being formed by a circumferential wall extending downwardly from a lower periphery of said body, an upper slab covering an upper opening within the circumferential wall, and a lower slab spaced from said upper slab and covering a lower opening within the circumferential wall so as to form substantially an entire bottom surface of the structure, said lower slab having a plurality of through holes distributed throughout its surface area; and a skirt protruding downwardly from a lower periphery of said circumferential wall; said method comprising the steps of:

pouring water into said ballasting means so as to sink the oceanic structure into a body of sea water by the combined weight of the structure and the water in the ballasting means to thereby settle the structure on a sea bottom; settling the structure on the sea bottom so as to thrust the skirt into the sea bottom and intercept the flow of sea water around the skirt and into ground under said structure; and periodically pumping water from the hollow bottom to the exterior of the structure to maintain pressure within the hollow bottom equal to the atmospheric pressure, so that said lower slab is pressed to the sea bottom by a pressure difference between upward air pressure applied to the upper slab and downward water pressure applied to the exterior of the structure.

2. The method according to claim 1, further comprising the steps of:

stopping the pumping of water from the hollow bottom; and pumping water from the ballast to the exterior of the structure.

3. The method according to claim 1, wherein the sea bottom is improved beforehand and the gravity type oceanic structure is installed on that improved sea bottom.

4. The method according to claim 1, wherein a periphery of the installed gravity type oceanic structure and the sea bottom around the structure are covered with an impermeable sheet to prevent sea water penetration from the circumference.

5. A gravity-type transferable oceanic structure comprising:

a body;

a hollow bottom, extending from a lower end of said body, which is of larger dimension in horizontal cross section than an upper portion of said body, said hollow bottom being formed by a circumferential wall extending downwardly from a lower periphery of said body, an upper slab covering an upper opening within the circumferential wall, and a lower slab spaced from said upper slab and covering a lower opening within the circumferential wall so as to form substantially an entire bottom surface of the structure, said lower slab having a plurality of holes bored therethrough and distributed throughout its surface area;

ballasting means provided within at least a portion of said body;

a skirt protruding downwardly from a lower periphery of the circumferential wall; and means for periodically pumping water from said hollow bottom;

wherein said holes enable sea water to flow from ground into the hollow bottom, thus preventing sea water from being trapped between the lower slab and a sea bottom; and further wherein as said skirts are thrust into the sea bottom upon settling of said structure on said sea bottom, said skirt intercepts flow of sea water into ground supporting the lower slab.

6. The gravity type oceanic structure as claimed in claim 5, wherein a plurality of vacant chambers are formed between the upper slab and the lower slab by radial partitions and a draining means is provided in each vacant chamber.

7. The gravity type oceanic structure as claimed in claim 5, wherein the lower slab installed on the sea bottom has a circular configuration.

8. The gravity type oceanic structure as claimed in claim 5, wherein the lower slab installed on the sea bottom has a square configuration.

9. The gravity-type transferable oceanic structure according to claim 5, wherein the hollow bottom is communicated with ambient air by means of a pipe extending upwardly from the interior of the hollow bottom.

10. The gravity-type transferable oceanic structure according to claim 5, wherein the lower slab has a plurality of protrusions protruding downwardly from the lower side of said lower slab.

* * * * *